US007011217B2

(12) United States Patent
Hanisch et al.

(10) Patent No.: US 7,011,217 B2
(45) Date of Patent: Mar. 14, 2006

(54) APPARATUS FOR SEPARATING COARSE GRAIN AND FINE GRAIN

(75) Inventors: Gerald Hanisch, Linz (AT); Heinz Jank, St. Valentin (AT)

(73) Assignee: HMH Engineering—Consulting Trading GmbH, Linz/Pichling (AT)

( * ) Notice: Subject to any disclaimer, the term of this patent is extended or adjusted under 35 U.S.C. 154(b) by 222 days.

(21) Appl. No.: 10/664,841

(22) Filed: Sep. 18, 2003

(65) Prior Publication Data

US 2004/0074815 A1 Apr. 22, 2004

(30) Foreign Application Priority Data

Sep. 19, 2002 (AT) ..... 1408/2002

(51) Int. Cl.
*B07B 1/04* (2006.01)

(52) U.S. Cl. ..... 209/354; 209/319; 209/415

(58) Field of Classification Search ..... 209/354, 209/314, 333, 325, 331, 336, 319, 420, 415, 209/353

See application file for complete search history.

(56) References Cited

U.S. PATENT DOCUMENTS 155,702 A * 10/1874 Brown ..... 209/314
327,050 A * 9/1885 Wulfert ..... 209/395
2,443,176 A * 6/1948 Banning ..... 209/395
2,775,347 A * 12/1956 Weston ..... 209/314
3,221,877 A * 12/1965 De Koning ..... 209/314
3,241,671 A * 3/1966 Brauchla ..... 209/243
5,310,065 A * 5/1994 Wark ..... 209/627
5,398,815 A * 3/1995 Hadden ..... 209/314
6,142,308 A * 11/2000 Ghosh et al. ..... 209/3

FOREIGN PATENT DOCUMENTS

DE 38 34 381 4/1990

* cited by examiner

*Primary Examiner*—Donald P. Walsh
*Assistant Examiner*—Kaitlin S. Joerger
(74) *Attorney, Agent, or Firm*—Collard & Roe, P.C.

(57) ABSTRACT

An apparatus is proposed for separating coarse grain and fine grain with a screen (1) made of screen bars (3) which are situated successively adjacent to one another and slope downwardly in the conveying direction (2) of the coarse grain and with a support (4) for the screen bars (3) which are fastened to one end of the support (4) and can be excited to performed oscillations by the material to be screened. In order to ensure an especially favorable screening effect at low maintenance and production costs it is proposed that the bar-like support (4) is held in a frame (6) in a manner torsionally resilient about its longitudinal axis (5) extending transversally to the screen bars (3) and that the screen bars (3) are arranged in at least two rows disposed successively in the conveying direction (2) of the coarse grain.

5 Claims, 3 Drawing Sheets

APPARATUS FOR SEPARATING COARSE GRAIN AND FINE GRAIN

FIELD OF THE INVENTION

The invention relates to an apparatus for separating coarse grain and fine grain with a screen made of screen bars which are situated successively adjacent to one another and slope downwardly in the conveying direction of the coarse grain and with a support for the screen bars which are fastened to one end of the support and can be excited to performed oscillations by the material to be screened.

DESCRIPTION OF THE PRIOR ART

When recycling construction residue masses or mining natural stone, the problem arises that it is necessary to remove coarse grain from the unscreened construction residue masses or from the natural stone in order to provide a final grain which is relieved of the share of coarse grain. For this purpose it is known in an apparatus for comminuting and preparing coarse-grained materials (DE 38 34 381 A1) to separate coarse grain from fine grain by means of a screen made of screen bars which are situated adjacently spaced from one another and which slope downwardly in the conveying direction of the coarse grain. In the known screen two rows of screen bars are disposed above each other, but in a mutually offset fashion. The screen bars are clamped on the one side in a support and are made to oscillate by the material to be screened. The coarse grain is guided over the screen in the direction of the longitudinal screen bar axes during the screening process and the fine grain flows transversally thereto through the screen. The screen bars are put into vibrations necessary for a favorable screening process during the screening process only in such regions of the screen by the material to be screened in which a sufficient quantity of material to be screened is guided over the screen. The screen bars of the other regions however are hardly made to oscillate. As a result, only a deficient screening effect can be achieved with such an apparatus. Moreover, the maximum screening effect is achieved only in the region of the ends of the screen bars which are opposite of the support due to the oscillation amplitudes prevailing there. Due to the closeness to the coarse grain ejection it is not possible to prevent that a far from inconsiderable amount of fine grain is screened out together with the coarse grain.

Furthermore, a plurality of vibrating screens are known which can be driven in a mechanical, electric or hydraulic way and although it is possible to achieve a clean separation between coarse grain and fine grain they are difficult to make, require much space and always need to be supplied with power which is why they cause high costs for their upkeep.

SUMMARY OF THE INVENTION

It is therefore the object of the present invention to provide an apparatus of the kind mentioned above which is characterized by a favorable screening effect with low costs for upkeep and production and low need for space.

This object is achieved by the invention in such a way that the bar-like support is held in a frame in a manner torsionally resilient about its longitudinal axis extending transversally to the screen bars and that the screen bars are arranged in at least two rows disposed successively in the conveying direction of the coarse grain.

Due to the fact that the support plus the screen bars which are held at one end on the support are held in an oscillatory way in the frame, the screen is made to oscillate over its entire width when the screen is charged with material to be screened, so that a favorable screening effect is achieved at all times with the apparatus in accordance with the invention because all screen bars fastened to a support are made to oscillate in virtually the same amount. The screening effect is improved even further by providing at least two rows of screen bars in the conveying direction of the coarse grain, because the regions of the largest oscillation amplitudes of the first screening row are situated far enough away from the coarse grain ejection. That is why the material to be screened is guided during the screening process over at least two screen rows which are mutually arranged in the conveying direction of the coarse grain, with the first screen row receiving the material flow and forwarding it to at least one further screen row. More or fewer screen rows can be provided depending on the still permissible share of fine grain in the coarse grain. Since screen bars have the largest oscillation amplitudes in the regions which are opposite of the support, it is possible to achieve a better screening effect with a larger number of screens. As a result of the torsionally resilient bearing of the support in the frame an especially low production effort is produced for the apparatus in accordance with the invention with which a high screening output can be achieved at extreme lightweight construction without any additional outside excitation of the screens. The support can be held relative to the frame via a torsion spring, torsion bar spring, plastic bearing or the like.

Especially advantageous conditions are obtained when the frame comprises at least two supports which are arranged successively behind each other in steps in the conveying direction of the coarse grain and are each provided with screen bars and are held in an oscillatory manner. This ensures that each screen row is made to oscillate in the best possible way due to the falling height of the material to be screened between the individual screen rows. The individual screens are arranged successively in the form of a cascade, with the rigidities of the torsion springs of the individual screen rows and supports being adjustable individually to the respective needs such as conveying quantity and grain size and length of screen bar and the like. The angles under which the individual screen bars are arranged in the frame must be optimized with respect to the conveying stream. It must always be ensured that in the case of optimal screening effect as little as possible fine grain remains in the screened coarse grain. The individual screen bars can be curved in the direction of their longitudinal axis and each act upon the support in a more or less oscillatory fashion, which thus also allows permitting and setting oscillations transversally to the conveying direction of the material to be screened.

The screen bars can be welded either directly to the support or the like. This entails the replacement of the entire support in the case of wear and tear. That is why it is especially advantageous when the screen bars each encompass the support by at least 90° and the screen bars are held on the support by means of a profile which receives the screen bars between itself and the support. The profile is screwed together with the support for example and fixes the screen bars relative to the support as a result of its clamping effect. The screen bars are then clearly fixed in their position with respect to the support and can also be held in an oscillatory capacity relative to the support if necessary. In order to guide the screen bars the profile preferably comprises recesses in which the screen bars can be placed. The apparatus in accordance with the invention can be attached as an additional module to any separating system. It is especially fastened to the delivery belt of said system. The apparatus can be arranged alone on the delivery belt or can be arranged with its frame in the transfer region of two conveyor belts and can be connected in a detachable way with at least one of the conveyor belts. The apparatus in accordance with the invention is characterized by its low weight and cost-effective design. As a result of the low weight and compact size, the mobility of the basic system is hardly limited and the apparatus forms a single transport unit, e.g. with a conveyor belt. It is especially advantageous when the supports with the screen bars and the frame form a modular unit which can be fastened to the belt head of a conveyor belt, thus providing an especially compact and light screening apparatus. In order to enable the apparatus in accordance with the invention to be transported with ease and to simultaneously increase strength (and especially stiffness against twisting), the frame may be provided with a transport frame.

BRIEF DESCRIPTION OF THE DRAWINGS

The invention is shown in the drawings by reference to an embodiment, wherein.

DESCRIPTION OF THE PREFERRED EMBODIMENTS

Figure 1:
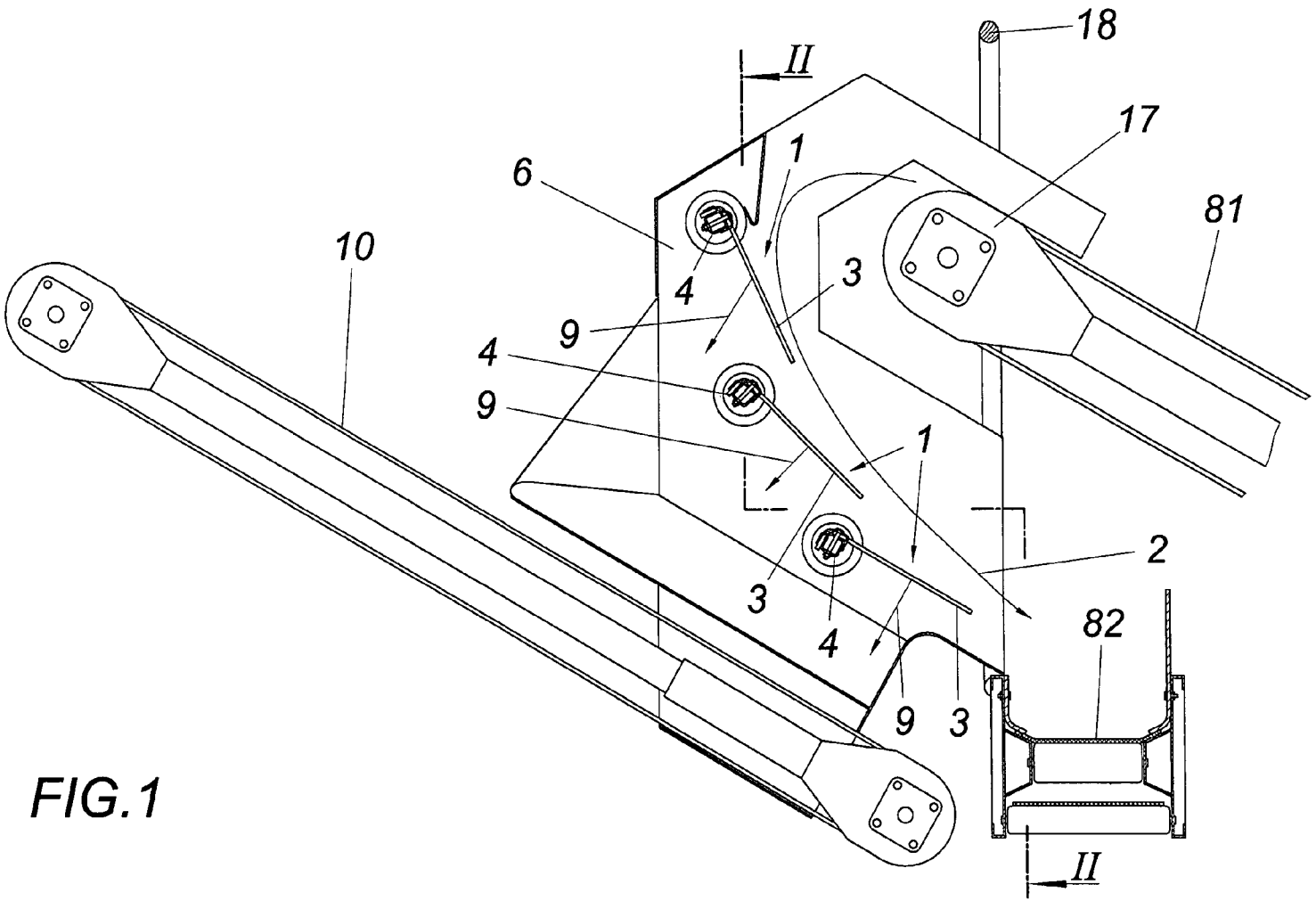
FIG. 1 shows an apparatus in accordance with the invention for separating coarse grain and fine grain in a partial sectional side view.
Figure 2:
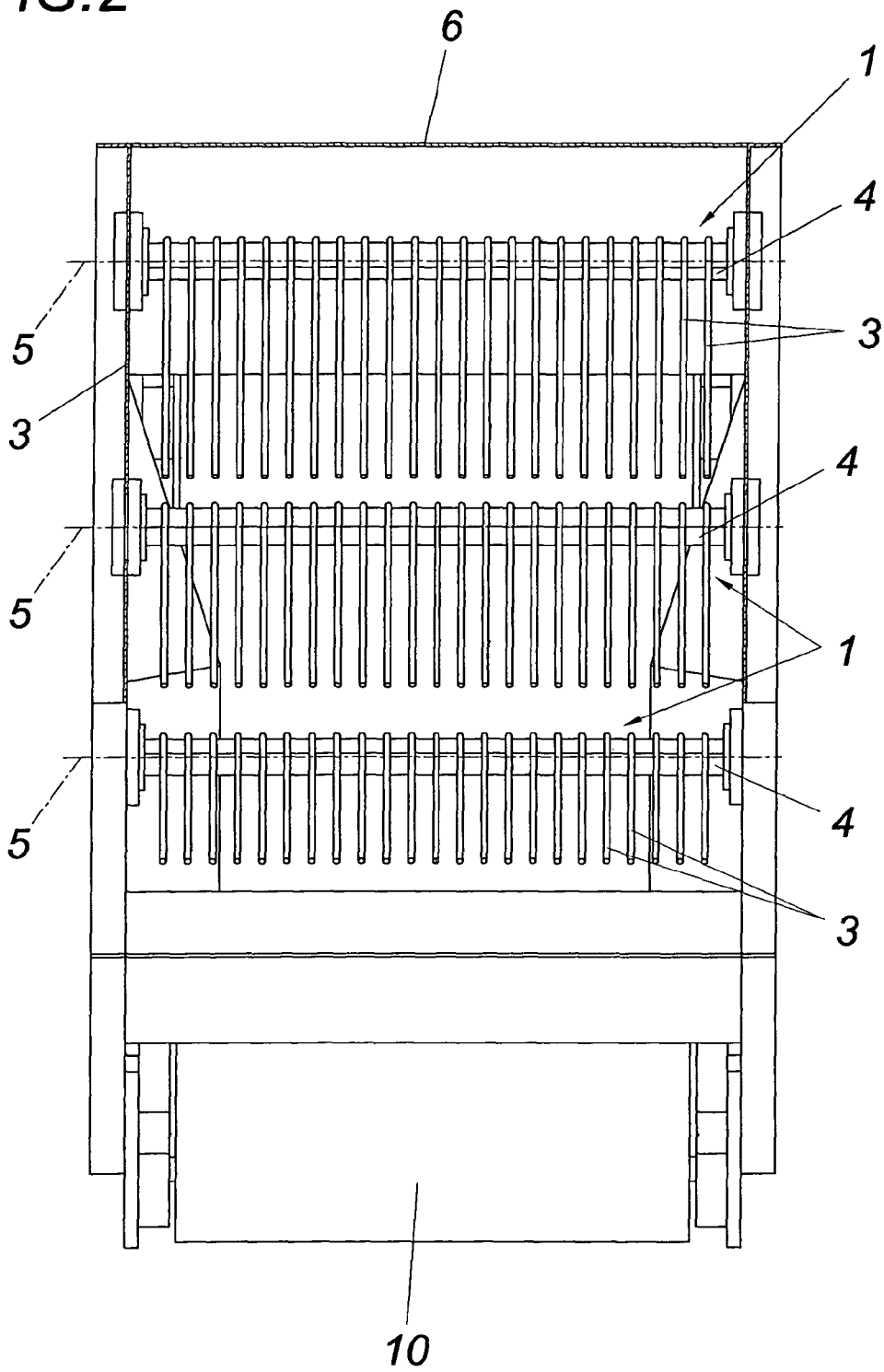
FIG. 2 shows the apparatus of FIG. 1 in a sectional view along line II—II.

An apparatus for separating coarse grain and fine grain consists of three rows of screens 1 made of screen bars 3 which are arranged at a distance from each other in rows adjacent to one another, slope downwardly in the conveying direction 2 of the coarse grain and are fastened with one end to a support 4. The bar-shaped supports 4 are held in a torsionally resilient way in a frame 6 by means of torsion springs 7 about their longitudinal axis 5 extending transversally to the screen bars 3. The screen bars 3 are arranged in three rows following successively in the conveying direction 2 of the coarse grain. Accordingly, three torsionally resiliently held units made of supports 4 and screen bars 3 are provided, with the three units being arranged in a stepped fashion one after the other in the conveying direction 2 of the coarse grain. A material to be screened which is to be separated into coarse grain and fine grain is supplied to the apparatus by means of a first conveyor belt 81, with the material to be screened being guided successively over the three successive rows of screens 1 by screening out the fine grain share. The coarse grain is conveyed by the screen bars 3 in its conveying direction 2 to a second conveyor belt 82, whereas the fine grain pours transversally to the conveying direction 2 of the coarse grain through the screen bars 3 in the direction of arrow 9 onto a third conveyor belt 10. The fine grain can be removed with the help of said third conveyor belt 10. The frame 6 is arranged in the transfer region of.,the first conveyor belt 7 to the third conveyor belt 10.

Figure 4:
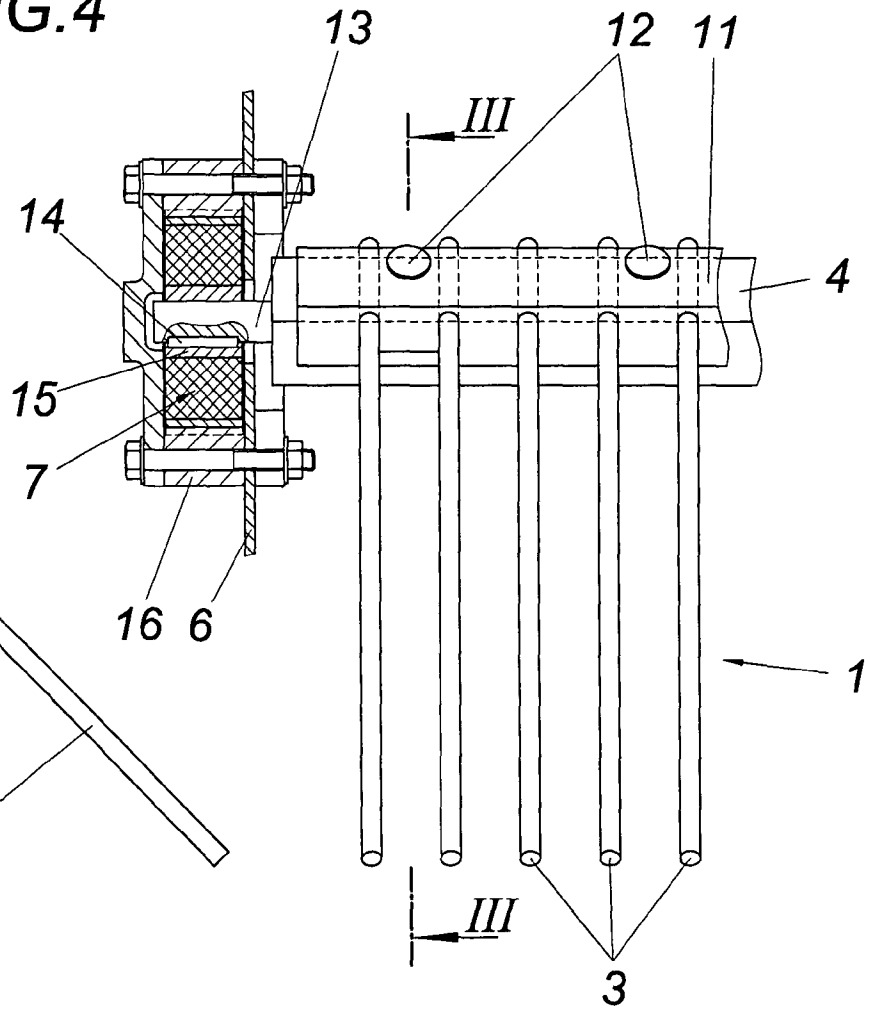
FIG. 4 shows the support plus screen bars of FIG. 3 plus torsion spring in a front view.
Figure 3:
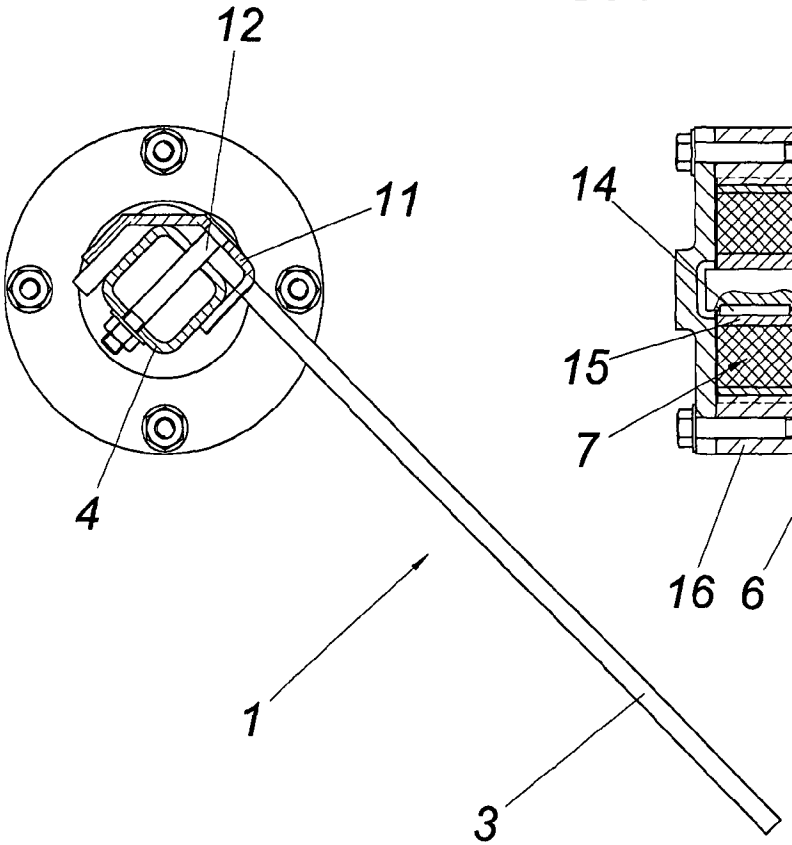
FIG. 3 shows a support plus screen bars of FIGS. 1 and 2 in a partial sectional front view on an enlarged scale.

The screen bars 3 each encompass the support 4 by 90° and are held on the support 4 by means of a profile 11. The screen bars 3 are clamped by means of gate band screws 12 between the support 4 and the profile 11. Recesses are provided in the profile 11 for the screen bars 3, which recesses are at least partly projected through by the screen bars 3, which allows the best possible positional fixing of the screen bars 3 relative to the support 4. According to the embodiment according to FIG. 4, the support 4 engages via a spring 14 in a torsionally secured manner in a hub 15 of the torsion spring 7 by means of an axle 13 formed on said support, which torsion spring 7 is screwed onto the frame 6 in a torsionally rigid way via a housing 16. Each support 4 can optionally be provided with merely one torsion spring 7 or the support is held in a torsionally resilient way in the frame 6 on both sides via torsion springs 7.

Together with the screen bars 3 and the frame, the supports 4 form a modular unit which can be fastened to the belt head 17 of the conveyor belt 81 and which is transportable both itself as well as in combination with conveyor belts and can be moved to the respectively desired place, for which purpose the frame 6 is provided with a transport frame 18.

What is claimed is:

1. An apparatus for separating coarse grain and fine grain, which comprises (a) a screen comprised of at least two rows of adjacently arranged screen bars sloping downwardly in a conveying direction of the coarse grain, the rows of screen bars being disposed successively in the conveying direction, and (b) a bar-shaped support for each row of the screen bars, the bar-shaped support being held in a frame in a manner torsionally resilient about a longitudinal axis extending transversely to the screen bars, (1) the screen bars having ends encompassing the bar-shaped support by at least 90° and held on the support by a profile receiving the screen bar ends between the support and the profile.

2. The apparatus of claim 1, wherein the bar-shaped supports are arranged in steps successively behin each other in the conveying direction.

3. The apparatus of claim 1, comprising two conveyor belts defining a transfer region therebetween, the frame being arranged in the transfer region and being detachably connected to a belt head of at least one of the conveyor belts.

4. The apparatus of claim 1, wherein the screens, the bar-shaped supports and the frame form a modular unit.

5. The apparatus of claim 1, further comprising a transport frame attached to the frame.

* * * * *